US010722923B2

(12) United States Patent
Cairns

(10) Patent No.: US 10,722,923 B2
(45) Date of Patent: Jul. 28, 2020

(54) HOLE-CLEANING METHOD AND APPARATUS

(71) Applicant: The Boeing Company, Chicago, IL (US)

(72) Inventor: Ian Dahl Cairns, Mercer Island, WA (US)

(73) Assignee: The Boeing Company, Chicago, IL (US)

( * ) Notice: Subject to any disclaimer, the term of this patent is extended or adjusted under 35 U.S.C. 154(b) by 168 days.

(21) Appl. No.: 15/928,035

(22) Filed: Mar. 21, 2018

(65) Prior Publication Data

US 2019/0291143 A1 Sep. 26, 2019

(51) Int. Cl.

| | |
|---|---|
| ***B08B 1/04*** | (2006.01) |
| ***B08B 9/00*** | (2006.01) |
| ***A47L 25/00*** | (2006.01) |

(52) U.S. Cl.

CPC ..... *B08B 1/04* (2013.01); *B08B 9/00* (2013.01); *A47L 25/00* (2013.01)

(58) Field of Classification Search

CPC .. B08B 9/00; B08B 9/027; B08B 1/04; B08B 1/003; B08B 1/008; B08B 1/001; B08B 1/006

See application file for complete search history.

(56) References Cited

U.S. PATENT DOCUMENTS

2005/0034259 A1* 2/2005 Condliff ..... B08B 1/008 15/210.1

* cited by examiner

*Primary Examiner* — Mikhail Kornakov
*Assistant Examiner* — Natasha N Campbell
(74) *Attorney, Agent, or Firm* — Kolisch Hartwell, P.C.

(57) ABSTRACT

Systems, methods, and a hole-cleaning apparatus for cleaning machined holes before measurement. The apparatus includes a probe that is inserted into a hole, and a spool support configured to support a spool of a cleaning material. During operation, cleaning material is drawn from the spool downward along the outer surface of the probe, and cleans the machined hole. The cleaning material then passes through an opening at the lower end of the probe, moves upward through an internal passage to an opening in the upper end of the probe, and is collected on a powered take-up reel.

21 Claims, 9 Drawing Sheets

HOLE-CLEANING METHOD AND APPARATUS

FIELD

This disclosure relates to systems, methods, and apparatus for cleaning machined holes. More specifically, the disclosed embodiments relate to methods and apparatus for cleaning sealant from holes machined using automated methods.

INTRODUCTION

A fay surface sealant may be applied at the interface between adjoining components of a given system, particularly when the prevention of corrosion is a high priority. A fay sealant is a flexible sealant that acts as a sealing membrane, and may prevent corrosion particularly where adjoining components may be of dissimilar materials.

Fay sealant may be applied to one or more components before they are assembled. Where the assembly process includes the machining of fastener holes and installation of fasteners, the assembly processes may include deburring and cleaning of component parts before a final assembly may be performed, sometimes requiring partial disassembly and reassembly before fasteners can be installed and the assembly completed.

Increasingly, such assembly processes are becoming automated, and in order to decrease operating costs and increase overall efficiency a goal of so-called "one-up" assembly is pursued. That is, the automated manufacturing process includes assembling components one time, and the assembly process is not interrupted for intermediate disassembly for deburring, cleaning, sealing etc.

However, where an industrial application demands high tolerances, such as the aeronautics industry, among others, machined surfaces such as fastener holes must be measured in order to confirm that they fall within established specifications. While some measurement devices may be used in conjunction with automated systems, if fay sealant has been expressed into the bore of a fastener hole during or after machining, the measurement device may be unable to accurately measure the fastener hole, or may even be damaged or destroyed by the presence of sealant.

Such machined fastener holes must therefore be cleaned before they can be measured. Unfortunately, in order to manually clean, inspect, and measure the fastener holes of a component assembly, the ongoing assembly process must be halted and the automated machinery removed in order to provide access to the fastener holes of the assembly.

What is needed is an apparatus that facilitates the rapid and effective cleaning of fastener holes that are formed in component assemblies, so that any fay sealant present in such holes may be removed, and any resulting delays in automated assembly can be minimized. More preferably, what is needed is a cleaning apparatus that lends itself to automated processes so that component assembly, cleaning, and inspection can be incorporated into an uninterrupted one-up assembly process.

SUMMARY

The present disclosure provides systems, methods, and apparatus, for cleaning holes and in particular for cleaning sealant from holes that have been machined using automated methods.

In some embodiments, the disclosure may provide a hole-cleaning apparatus that may include a frame, and an elongate probe coupled to the frame and projecting downward. The probe may define an internal passage extending from a lower end of the probe to an upper end of the probe. A spool support having an aperture may be attached to the frame and configured to support a spool of a cleaning material in such a way that the cleaning material may be dispensed from the spool through the aperture and along the outer surface of the elongate probe. The apparatus may be configured so that the cleaning material may then pass through the internal passage within the elongate probe from the probes' lower end, pass upwardly and exiting at the upper end of the probe. A powered take-up reel may be mounted to the frame and configured to apply tension to the cleaning material that extends out of the internal passage, causing the cleaning material to be dispensed from the spool, collecting the cleaning material on the reel after it has passed through the internal passage.

In some embodiments, the disclosure may provide a hole-cleaning apparatus that may include a support plate defining an aperture. A cylindrical tube may be disposed within the aperture in the support plate, with a rolled-up cleaning material disposed on the support plate and around the aperture. A portion of the rolled-up cleaning material may be unrolled to extend through the aperture, along the outside of the cylindrical tube, then into t the cylindrical tube. A motor-driven drum may be coupled to the cleaning material that extends through the cylindrical tube, so that operation of the motor-driven drum pulls cleaning material through the cylindrical tube and continually dispenses cleaning material from the support plate to pass along the outside of the cylindrical tube. In this way, when the cylindrical tube of the apparatus is inserted into a hole containing sealant, the cleaning material may remove sealant from within the hole.

In some embodiments, the disclosure may provide a method of cleaning a hole, where the method may include installing a spool of a cleaning material on a hole-cleaning apparatus. The hole-cleaning apparatus itself may include a frame, with an elongate probe coupled to and projecting downward from the frame. The elongate probe may define an internal passage that extends from the lower end to the upper end of the probe. The apparatus may include a spool support having an aperture that is attached to the frame and configured to support an installed spool of cleaning material in such a way that the cleaning material can be dispensed from the spool through the aperture and along the outer surface of the elongate probe. The cleaning material may then pass into the lower end of the probe, and through the internal passage. A powered take-up reel may be mounted to the frame and configured to apply tension to the cleaning material after it passes through the internal passage by receiving the cleaning material and collecting it on the reel. The method may further include drawing the cleaning material along an outer surface of the elongate probe, through the internal passage, and attaching the cleaning material to the powered take-up reel. The method may further include inserting the elongate probe into a hole and operating the powered take-up reel so that the cleaning material being dispensed from the spool contacts and cleans an interior surface of the hole.

The disclosed features, functions, and advantages may be achieved independently in various embodiments of the present disclosure, or may be combined in yet other embodiments, further details of which can be seen with reference to the following description and drawings.

DESCRIPTION

Figure 1:
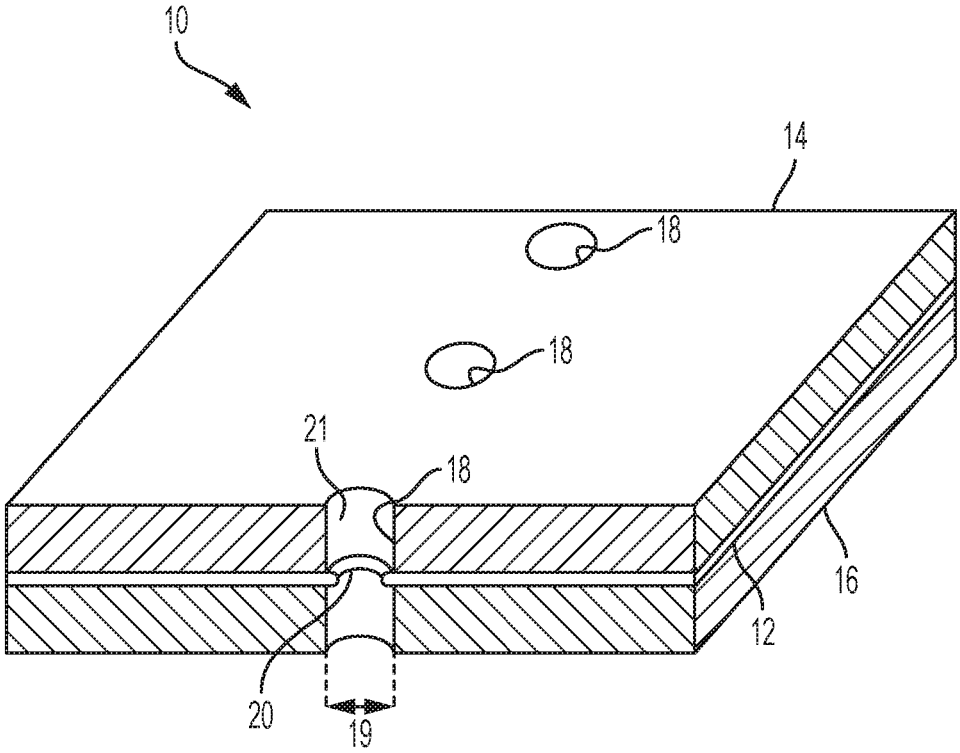
FIG. 1 depicts a portion of an assembly component including machined fastener holes. The assembly component includes fay sealant sandwiched between a first and a second panel, where the sealant has been partially expressed into the interior of the machined holes.

Various aspects and examples of a hole-cleaning apparatus, as well as systems including a hole-cleaning apparatus, and methods for utilizing a hole-cleaning apparatus are described below and illustrated in the associated drawings. Unless otherwise specified, a hole-cleaning apparatus and/or its various components may, but are not required to, contain one or more of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments will necessarily provide the same advantages or the same degree of advantages.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"Coupled" means connected, either permanently or releasably, whether directly or indirectly through intervening components, and is not necessarily limited to physical connection(s).

The hole-cleaning apparatus, systems, and methods of cleaning machined holes of the present disclosure may be described in the context of aircraft manufacture. It should be appreciated that various embodiments of the disclosed apparatus, systems, and methods may and likely will possess enhanced utility in a number of alternative manufacturing processes, particularly those that incorporate automated assembly and machining. The present disclosure should not be considered to be limited to aircraft manufacture.

For the purposes of the present disclosure, directional terms such as "up," "down," "upwardly," "downwardly," "vertical," "horizontal," and the like should be understood to be defined within the context of the machined hole to be cleaned by the disclosed hole-cleaning apparatus, where the machined hole shall be defined as extending downwardly from a horizontal component surface. That is, when the elongate probe of a disclosed hole-cleaning apparatus is inserted into a machined hole, the elongate probe shall be described as extending "downwardly." It should nevertheless be appreciated that the hole-cleaning apparatus of the present disclosure may be utilized in any desired orientation, may be utilized in conjunction with an assembly component having any desired orientation, and may be utilized in differing orientations when cleaning machined holes formed in the same assembly component, without limitation.

Overview

Referring to FIG. 1, a portion of an exemplary component 10 is depicted semi-schematically. Component 10 may include a layer of fay sealant 12 sandwiched between a first panel 14 and a second panel 16. First panel 14 and second panel 16 may include metals, metal alloys, or composite materials, among others. In one aspect of the disclosure, component 10 is a component of an assembly that may be used in the construction of an aircraft, particularly a commercial aircraft. In a particular aspect of the disclosure, component 10 may be a component of an assembly that may be useful in the manufacture of a fuselage of an aircraft.

Fay sealant 12 may be disposed between first panel 14 and second panel 16 to provide a seal against moisture and/or to prevent corrosion of component 10 or other components of the final component assembly. Fay sealant 12 may be applied to one or both of panels 14 and 16 before the panels are assembled to form component 10, which is then machined to form one or more fastener holes 18 in component 10, the fastener hole having an associated hole diameter 19, as shown in cut-away view in FIG. 1. During handling or machining of component 10 compression or other stresses may express fay sealant 12 from the region intermediate panels 14 and 16 and into the interior of machined hole 18, as represented by protruding sealant bead 20.

A hole-cleaning apparatus of the present disclosure may be configured to clean the interior wall(s) 21 of a fastener hole 18 machined in a component of an assembly, either prior to incorporation in the assembly, or after the component has been incorporated. The apparatus of the present disclosure may be configured to be useful for cleaning the interior of holes and apertures formed in a variety of components, and may be useful for removing any of a variety of contaminants and/or residues from such holes by customizing the nature of the cleaning material and the particular conformation of the elongate probe. The disclosed apparatus may be particularly advantageous when configured to be used to clean sealant that may be present in a machined hole, such as a hole for a fastener. The apparatus may be incorporated as a handheld tool, a nonportable device, or a component of a larger manufacturing system, such as an automated system.

Figure 2:
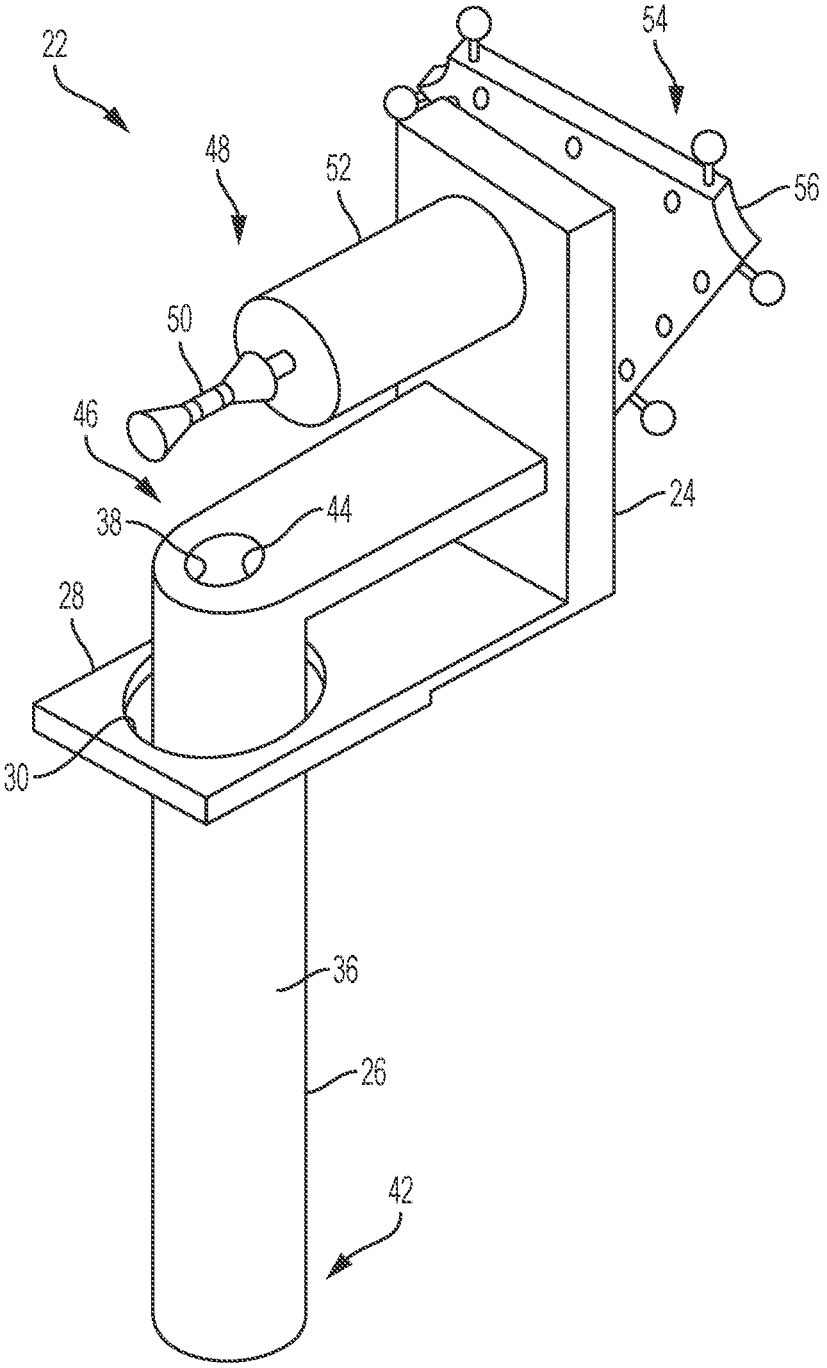
FIG. 2 is an isometric depiction of an illustrative hole-cleaning apparatus according to the present disclosure.

An exemplary hole-cleaning apparatus 22 is shown in FIG. 2. Apparatus 22 may include a frame 24. The various components of apparatus 22 may be coupled to frame 24, which is in turn configured to couple to and support the various components of apparatus 22 before and during operation of the apparatus.

Hole-cleaning apparatus 22 may include an elongate probe 26 that is coupled to frame 24 in such a way that elongate probe 26 projects generally downwardly from frame 24. Although probe 26 may be generally vertically elongate, the particular configuration of probe 26 is dependent upon the size and shape of machined holes that apparatus 22 may be used to clean. Generally, elongate probe 26 is sized and shaped so that it may be at least partially inserted into a machined hole in an assembly component. More generally, the elongate probe has an outer circumference that is shaped similarly to the bore of the machined hole to be cleaned. Typically, the hole to be cleaned has a cylindrical bore, and the elongate probe is also substantially cylindrical but has an outer diameter that is at least somewhat smaller than the inner diameter of the bore of the machined hole to be cleaned.

The shape and size of elongate probe 26 may be customized to suit the size and shape of a machined hole 18 to be cleaned. In particular, elongate probe 26 may be selected to have a particular length, width, and cross-sectional profile in order to match the dimensions of the machined hole 18 to be cleaned. Hole-cleaning apparatus 22 may be configured so that various examples of elongate probe 26 may be interchangeable, so that a desired length, width, and cross-sectional profile for elongate probe 26 can be selected and installed quickly and conveniently.

Hole-cleaning apparatus 22 may also include a spool support 28 that is coupled to frame 24, where spool support 28 defines an aperture 30 within which elongate probe 26 extends downwardly. That is, spool support 28 surrounds a portion of elongate probe 26, which is disposed within aperture 28. Spool support 28 may be configured to support a spool 32 of a cleaning material 34 in such a manner that the cleaning material 34 can be dispensed from spool 32 downwardly through aperture 30 and along an outer surface 36 of elongate probe 26.

Elongate probe 26 may be further configured so as to define an internal passage 38. Internal passage 38 may extend from an opening 40 at a lower end 42 of elongate probe 26 to an opening 44 at an upper end 46 of elongate probe 26.

The components of hole-cleaning apparatus 22 may be configured so that when cleaning material 34 is dispensed downwardly along outer surface 36 of elongate probe 26, cleaning material 34 can then enter opening 40 at the lower end 42 of elongate probe 26 and be drawn upwardly through internal passage 38 to exit at opening 44 at upper end 46 of elongate probe 26.

Internal passage 38 may have any conformation, provided that the internal passage permits cleaning material 34 to move along the interior of internal passage 38 without restriction or unwanted friction. Generally, the lip of lower opening 40 and the lip of upper opening 44 are rounded and smooth, to minimize fraction with cleaning material 34. Similarly, the internal walls of internal passage 38 may be generally smooth, without projections. More generally, internal passage 38 is a substantially cylindrical passage defined by the circumferential sidewall 47 of elongate probe 26. Typically, the elongate probe has a cylindrical profile, and sidewall 47 defines a cylindrical and concentric internal passage 38.

Hole-cleaning apparatus 22 may also include a powered take-up mechanism 48 that is coupled to frame 24 and configured to apply tension to a portion of cleaning material 34 extending from upper end 46 of elongate probe 26. Powered take-up mechanism 48 may include a take-up reel 50 that is configured to be rotated by a motor 52, so that cleaning material 34 is collected by being wound upon take-up reel 50 after cleaning material 34 has passed upwardly through internal passage 38. It is the tension provided by powered take-up mechanism 48 as it collects cleaning material 34 that draws cleaning material 34 from spool 32 and pulls it downwardly along outer surface 36 of elongate probe 26.

Hole-cleaning apparatus 22 may further include an adapter 54 that provides a means of operation of the apparatus. In one aspect of the disclosure, adapter 54 may include a handle that permits apparatus 22 to be operated manually as a hand tool. Where hole-cleaning apparatus 22 is used manually and/or as a hand tool, the apparatus may include a power source that is coupled to motor 52 and configured to energize take-up mechanism 48. Where apparatus is configured to be operated manually, adapter 54 may include such a power source and/or a control to energize motor 52.

Alternatively, or in addition, hole-cleaning apparatus may be configured to be coupled to an end effector of an automated industrial robot arm, and adapter 54 may be or may include a mounting plate 56 configured to connect apparatus 22 to an end effector. Where adapter 54 includes a mounting plate 56, the mounting plate may be reinforced, and may include one or more threaded apertures which are adapted to cooperate with and receive fasteners to enable mounting on a desired end effector. Mounting plate may optionally further incorporate any additional connections, such as power conduits, control lines, among others that are configured to permit or enhance a remote and automated operation of apparatus 22.

Cleaning material 34 may include any suitable substance useful for cleaning an inner surface of a machined hole. Generally, cleaning material 34 may have a semi-rough texture to better remove sealant from the interior of a hole. In one aspect of the disclosure, cleaning material 34 is fibrous in character—that is, the cleaning material incorporates a plurality of individual fibers, such as by compressing such fibers together or by weaving them into a material, among other methods. Cleaning material 34 may be selected to be absorbent with respect to either aqueous-based or non-aqueous-based substances. Alternatively, cleaning material 34 may be configured to adhere to and trap those substances to be removed from a machined hole, without necessarily absorbing them.

Cleaning material 34 may be installed on apparatus 22 by placing an amount of cleaning material 34 in the form of a spool 32 on spool support 28, typically by detaching or otherwise removing spool support 28 from its position surrounding elongate probe 26. Once spool 32 is place on spool support 28, the spool support may be replaced with spool 32 resting on the spool support.

By "spool" is meant any collection of cleaning material capable of being gradually paid out under tension through aperture 30, and then pass along outer surface 36 of elongate probe 26. As used herein, spool 32 may include a strand, ribbon, sheet, or sheath of cleaning material. Spool 32 may include cleaning material that is wound onto a form such as a spool, reel, bobbin, or other cylindrical form. Alternatively, spool 32 may include a cleaning material that is coiled upon itself in the absence of a central form, and is optionally held in the shape of a coil by the presence of a gentle (i.e. easily reversible) adhesive or a stiffening agent.

EXAMPLES, COMPONENTS, AND ALTERNATIVES

The following sections describe selected aspects of exemplary hole-cleaning apparatus, as well as related systems and/or methods. The examples in these sections are intended for illustration and should not be interpreted as limiting the entire scope of the present disclosure. Each section may include one or more distinct embodiments or examples, and/or contextual or related information, function, and/or structure.

Example 1

This example describes an alternative illustrative hole-cleaning apparatus.

Figure 3:
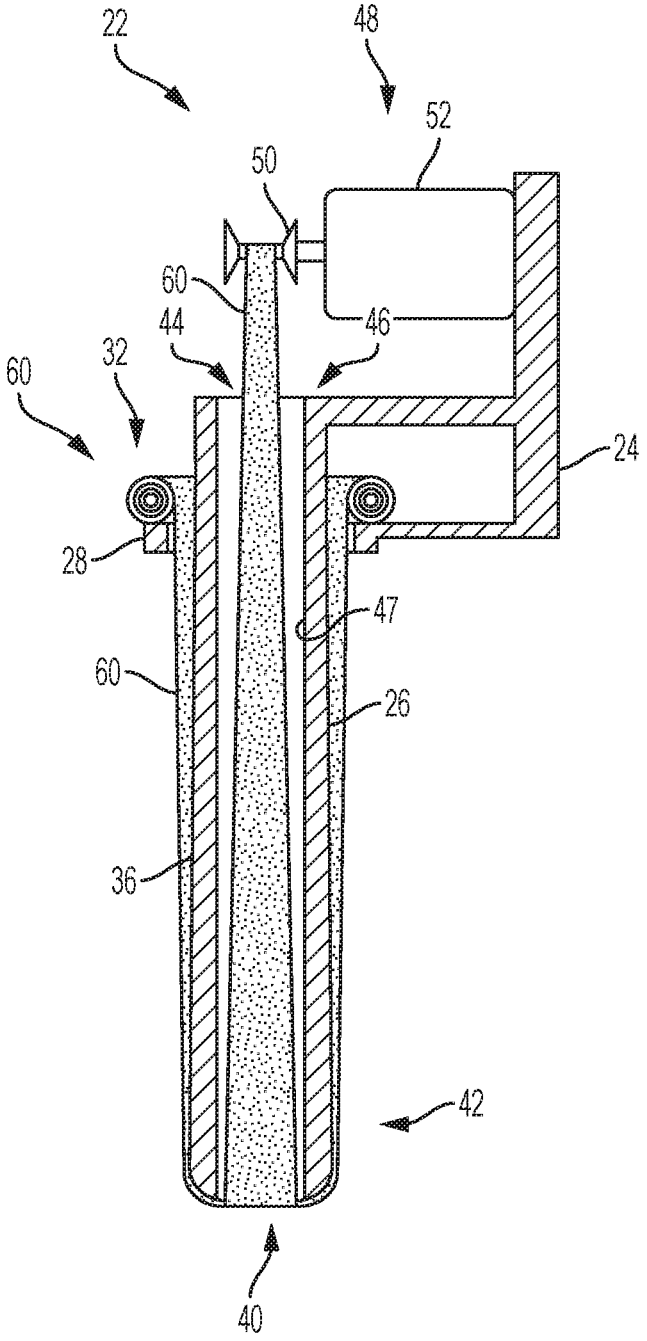
FIG. 3 is a side view of an illustrative hole-cleaning apparatus according to the present disclosure employing cleaning material in the form of a tube, with the spool of cleaning material, the spool support, and the elongate probe of the apparatus shown in cross-section.

In one aspect of the disclosure, spool 32 may include an elongated tube of cleaning material 34 that is rolled up upon itself to form a spool that is a torus of rolled cleaning material 34, as shown in FIG. 3. As shown in the sectional view, apparatus 22 includes a spool 32 of an elongated tube 60 of cleaning material 34 that is unrolled and fed downwardly and along the outer surface 36 of elongate probe 26 in the manner of a sock or sheath. As cleaning material 34 has the form of a tube or sock, the tube 60 of cleaning material 34 may clean an inner surface of an entire machined hole simultaneously. As shown in FIG. 3, the tube 60 of cleaning material 34 may be pulled downwardly to lower end 42 of probe 26, where it is then drawn upwardly through opening 40 and through internal passage 38 to exit probe 26 via opening 44. The tube 60 of cleaning material 34 is urged upwardly by a tension provided by take-up reel 50 when powered by take-up motor 52, and tube 60 of cleaning material 34 is wound onto take-up reel 50.

Figure 4:
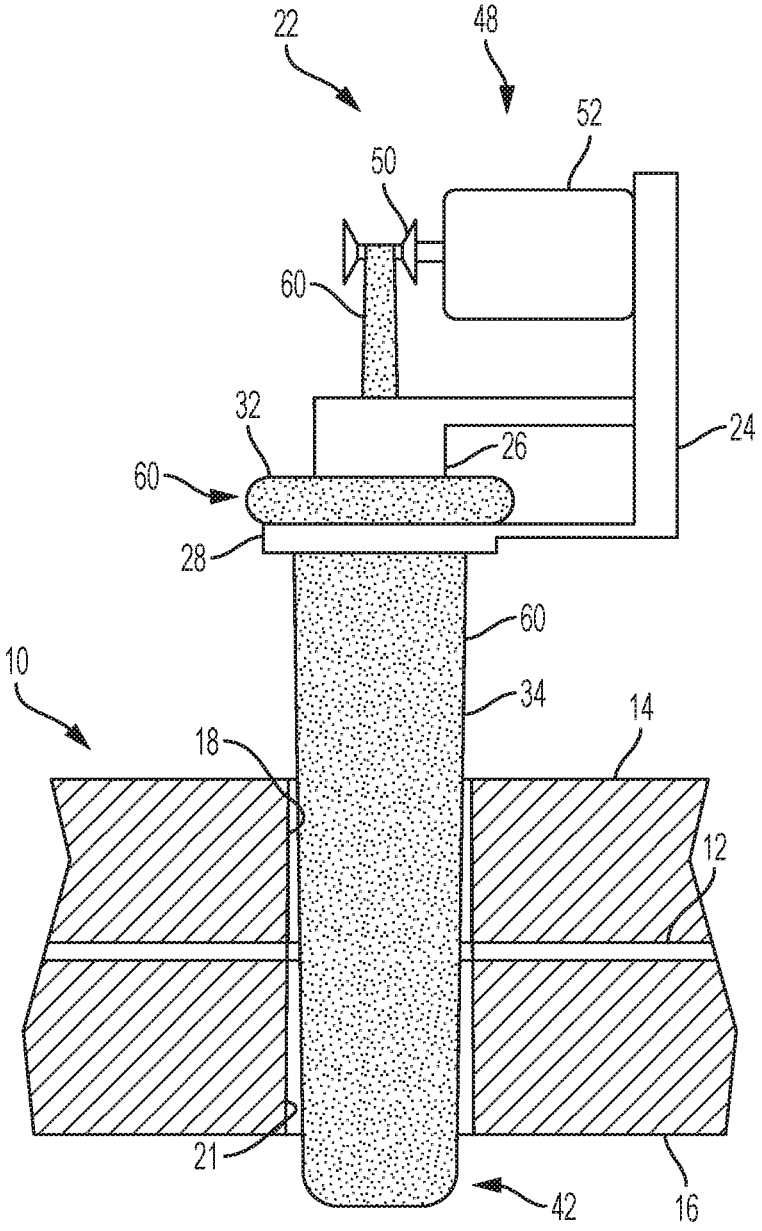
FIG. 4 is a side view of the hole-cleaning apparatus of FIG. 3 inserted into a machined hole in an assembly component, where the component is shown in cross-section.

The hole-cleaning apparatus 22 of FIG. 3 is also shown in FIG. 4, with apparatus 22 inserted into a machined fastener hole 18 formed in a component 10. It should be apparent that by selection of an appropriate size and shape for elongate probe 26 and cleaning material 34, a close fit may be obtained between the cleaning material and the inner wall 21 of the machined hole 18.

Example 2

This example describes an alternative illustrative hole-cleaning apparatus.

Figure 5:
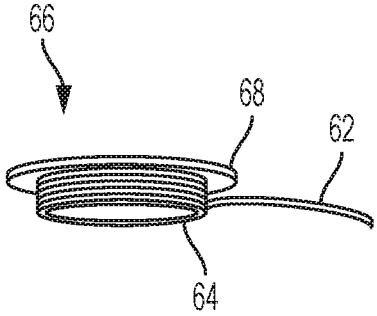
FIG. 5 is a lower perspective view of an illustrative bobbin of cleaning material, according to the present disclosure.
Figure 6:
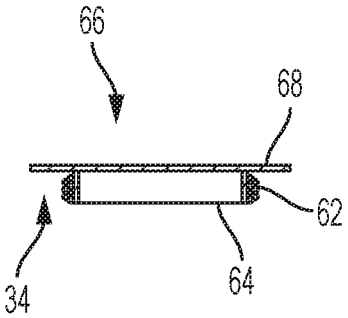
FIG. 6 is a cross-section view of the bobbin of cleaning material of FIG. 5.

In an alternative aspect of the disclosure, a spool 32 of cleaning material 34 may include a thread, ribbon, tape, or floss, that may be rolled up on a cylindrical form. For example, as shown in FIGS. 5 and 6, a strand 62 of cleaning material 34 is wound onto a cylindrical section 64 of a bobbin 66, which projects downward from a flange 68 having a greater diameter than cylindrical section 64.

Figure 7:
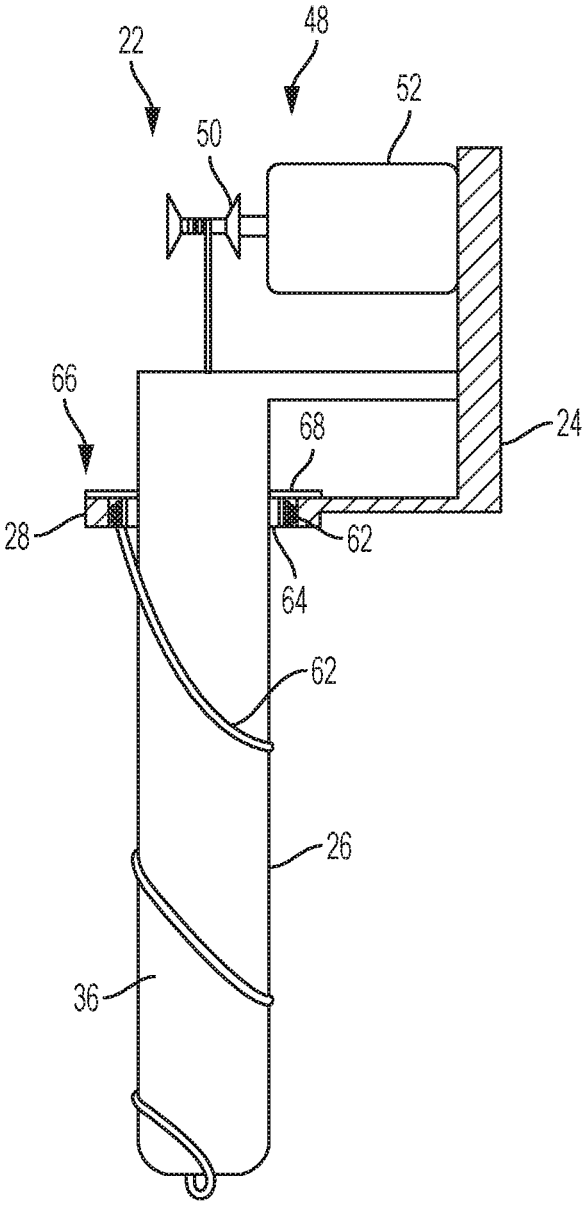
FIG. 7 is a side view of an illustrative hole-cleaning apparatus according to the present disclosure employing the bobbin of FIGS. 5 and 6, where the spool support and the bobbin are shown in cross-section.

FIG. 7 depicts a hole-cleaning apparatus 22 of the present disclosure, including a bobbin 66 with cleaning material 34 wound onto cylindrical section 64. Bobbin 66 is disposed around elongate probe 26, and on spool support 28 in such a way that upper flange 68 of bobbin 66 rests flat upon spool support 28, and at least a portion of cylindrical section 64 extends downwardly and at least partially into aperture 30 of spool support 28. At least a portion of cylindrical section 64 is disposed between spool support 28 and the outer surface 36 of elongate probe 26. As described for previous examples, strand 62 of cleaning material 34 may be drawn downwardly along the outer surface 36 of elongate probe 26, through lower opening 40 and upwardly through internal passage 38 to be wound onto take-up reel 50, as shown in FIG. 7. Due to strand 62 being wound around bobbin 66, as strand 62 is drawn downwardly it is necessarily unspooled in a circular fashion. In this way the cleaning material 34 may contact substantially the entire inner wall 21 of a machined fastener hole 18.

It should be appreciated that bobbin 66 is merely one example of a form upon which a cleaning material may be disposed that may in turn be useful in a hole-cleaning apparatus of the present disclosure, and that many other variations on such spools, reels, or bobbins may be envisioned by one of skill.

Example 3

This example describes an alternative illustrative hole-cleaning apparatus.

Figure 8:
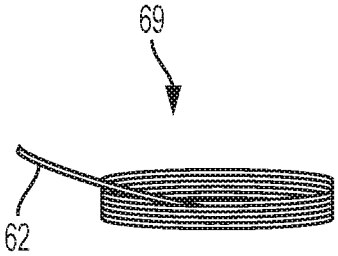
FIG. 8 is a perspective view of an illustrative coil of cleaning material, according to the present disclosure.
Figure 9:
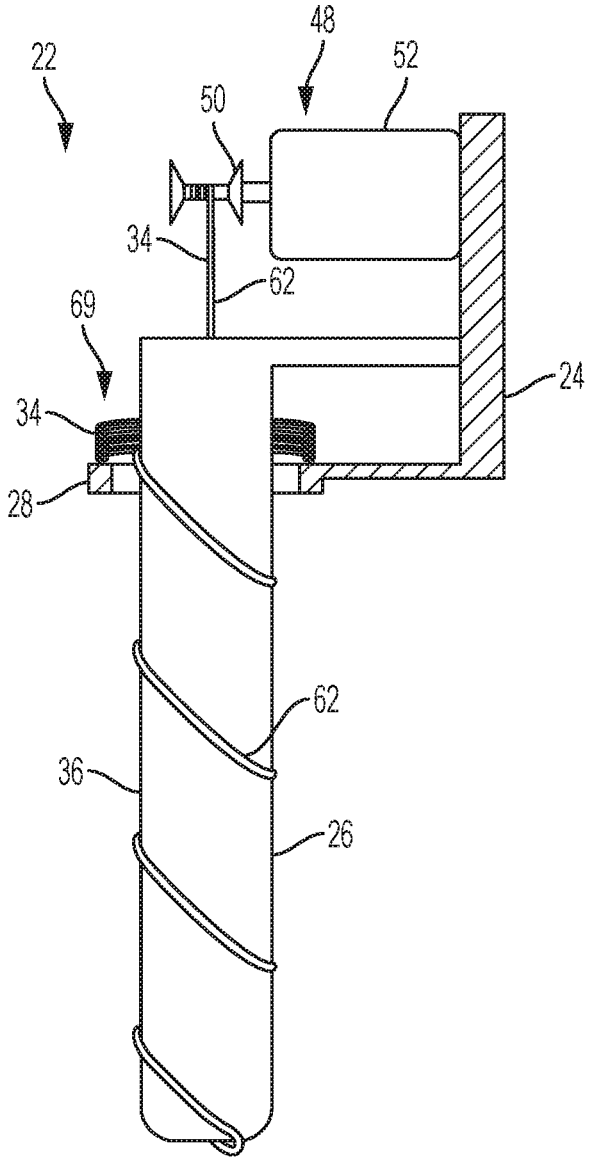
FIG. 9 is a side view of an illustrative hole-cleaning apparatus according to the present disclosure employing the cleaning material coil of FIG. 8, where the spool support and the coil are shown in cross-section.

In an alternative aspect of the disclosure, a spool 32 of cleaning material 34 may include a strand 62 that is a thread, ribbon, tape, or floss of cleaning material that is formed into a coil 69, similar to a coil of rope, or garden hose, as shown in FIG. 8. That is, instead of winding cleaning material 34 onto a reel or bobbin, due inherent stiffness of the cleaning material 34 and/or by virtue the application of a mild and reversible adhesive to the cleaning material 34, coil 69 may retain its shape when disposed upon spool support 28, as shown in FIG. 9. When coiled in this fashion, strand 62 may be drawn from the inner surface of coil 69, pulled downwardly along the outer surface 36 of elongate probe 26, through lower opening 40 and upwardly through internal passage 38 to be wound onto take-up reel 50, as shown. As discussed in Example 2, as strand 62 is uncoiled in a circular fashion and pulled downward, cleaning material 34 may contact and clean substantially the entire inner wall 21 of a machined fastener hole 18.

Example 4

This example describes an alternative illustrative hole-cleaning apparatus.

Figure 10:
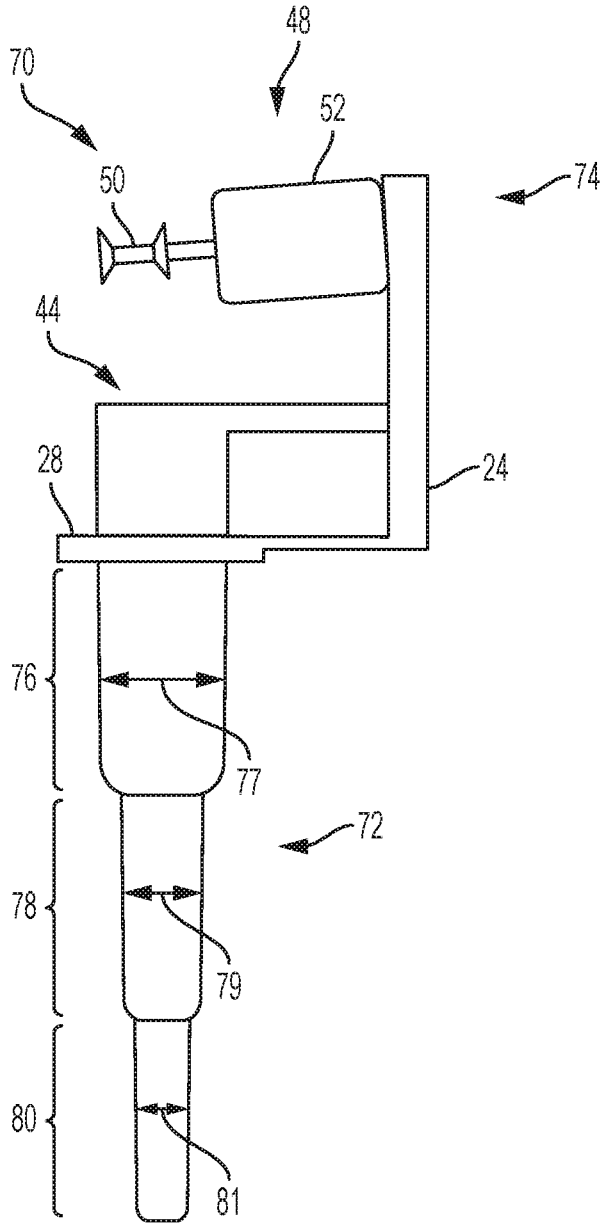
FIG. 10 is a side view of an alternative illustrative hole-cleaning apparatus according to the present disclosure, the apparatus including an offset take-up reel and an elongate probe that includes regions of differing diameters.

In an alternative aspect of the disclosure, an alternative configuration of a hole-cleaning apparatus 70 is shown in FIG. 10, including an alternative stepped elongate probe 72 and a spool support 28, which are coupled to a frame 24. The apparatus 70 is configured in such a way that take-up reel 50 of powered take-up mechanism is offset from the upper opening 44 in stepped probe 72. In this way, if sealant and other materials adhering to cleaning material 34 were dislodged while the cleaning material were drawn upwardly and wound onto take-up reel 50, the dislodged materials would not fall down into internal passage 38 and potentially recontaminate the inner wall 21 of fastener hole 18.

Although hole-cleaning apparatus 70 is depicted as angling an upper portion 74 of frame 24 sufficiently to offset take-up reel 50 from a position directly above internal passage 38, it should be appreciated that any number of approaches and modifications to the hole-cleaning apparatus of the disclosure may also be implemented to offset a portion of powered take-up mechanism 48 from a position in-line with the elongate probe.

As shown, stepped elongate probe 72 may include three discrete probe regions 76, 78, and 80 having distinct diameters 77, 79, and 81, respectively. In this configuration, hole-leaning apparatus 22 may employ elongate probe 72 to clean the interior walls of machined holes of varying diameter without the necessity of changing probes. The regions 76, 78, and 80 may each be sized to correspond to a different hole diameter 19, where each region may correspond to the diameter 19 of a different size of machined hole 18.

Although probe 72 is shown with three distinct stepped regions, any particular elongate probe might have two, three, four, or more distinctly-sized regions, in order to confer flexibility of use on the hole-cleaning apparatus 22. Similarly, although the sized regions 76, 78, and 80 are separated by step changes in probe circumference, the transition between regions may be more gradual, incorporating more or less gradually changing circumferences between such regions.

In an alternative configuration, elongate probe 26 may have a substantially continuously varying circumference along the length of the probe. In this configuration, probe 26 may be inserted into a machined hole 18 sufficiently far that the cleaning material 34 will clean the interior surface of the inner wall 21 of the hole adequately, but not so far that the taper of the probe will result in the cleaning material being pinched between the probe and the walls of the hole.

Example 5

This example describes an illustrative method of cleaning a hole using a hole-cleaning apparatus as described above. Aspects of hole-cleaning apparatus 22 may be utilized in the method steps described below. Where appropriate, reference may be made to previously described components and systems that may be used in carrying out each step, and further components may be described with regard to the examples below. These references are for illustration, and are not intended to limit the possible ways of carrying out any particular step of the method.

Figure 11:
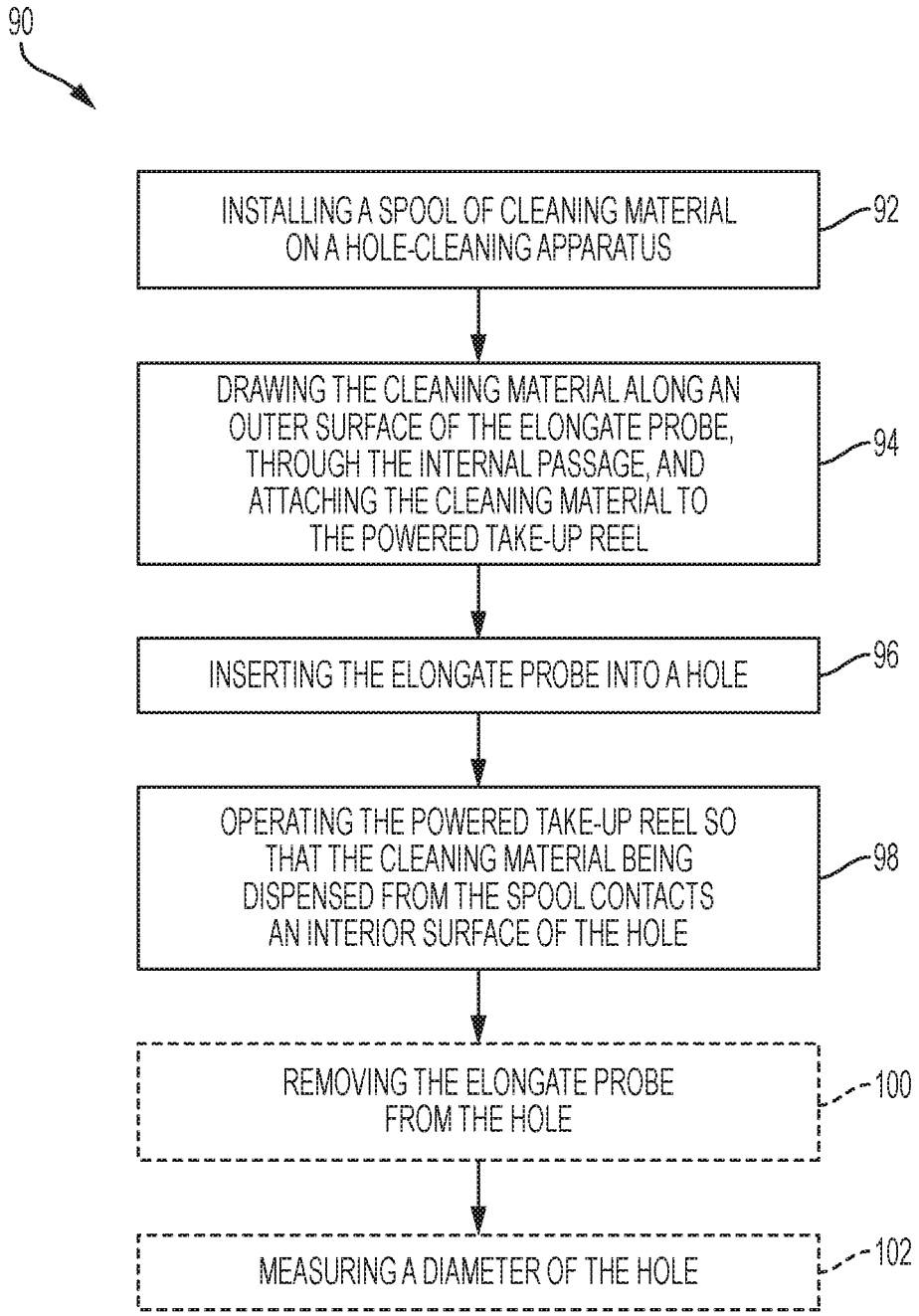
FIG. 11 is a flowchart representing a method according to the present disclosure of cleaning a hole with a hole-cleaning apparatus.

FIG. 11 depicts a flowchart 90 illustrating operations or steps performed in the illustrative method. Although various steps of method 90 are described below and depicted in FIG. 10, the steps need not necessarily all be performed, and in some cases may be performed in a different order than the order shown.

At step 92, a spool 32 of cleaning material 34 may be installed on an aperture-cleaning apparatus 22. At step 94, the cleaning material 34 may be drawn along an outer surface 36 of elongate probe 26, through internal passage 38, and attached to a powered take-up reel 50. At step 96, elongate probe 26 may be inserted into a hole 18. At step 98, the powered take-up reel 50 may be operated so that the cleaning material 34 is dispensed from the spool 32 and cleans the interior surface of the inner wall 21 of the hole 18.

As shown at steps 100 and 102, respectively, the method of flowchart 90 may optionally further include removing elongate probe 26 from hole 18, and measuring a diameter 19 of hole 18.

In one aspect of the disclosed method, activating powered take-up reel 50 only occurs while elongate probe 26 is inserted into hole 18.

In another aspect of the disclosed method, inserting the elongate probe 26 into hole 18 includes inserting the elongate probe 26 into a hole 18 machined in a workpiece component that includes two or more laminae 14, 16 separated by a sealant layer 12.

In another aspect of the disclosed method, aperture-cleaning apparatus 22 is coupled to an end effector 104 of an industrial robotic arm assembly 106, and the steps of inserting the elongate probe 26 into the hole 18 and activating the powered take-up reel 50 occur autonomously.

Example 6

This example describes an illustrative automated system configured to operate a hole-cleaning apparatus as described above.

Figure 12:
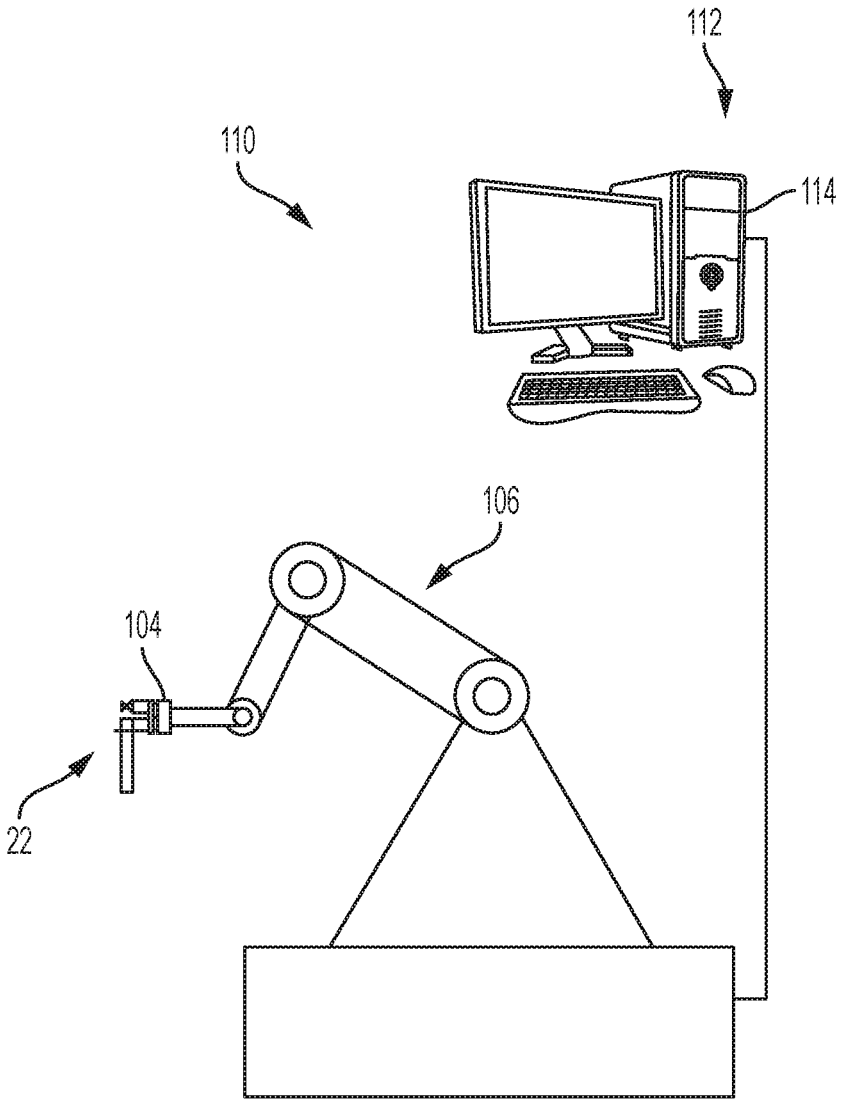
FIG. 12 is a semi-schematic representation of an illustrative automated hole-cleaning system, according to the present disclosure.

Hole-cleaning apparatus 22 may be a component of an automated system 110, as depicted schematically in FIG. 12. Automated system 90 may include a hole-cleaning apparatus 22 that may be coupled to an end-effector 104 of a robotic arm assembly 106, where the robotic arm assembly 106 is capable of moving hole-cleaning apparatus 22 to a series of machined holes 18 in a work piece, inserting the elongate probe 26 sequentially into each machined hole 18, and energizing the hole-cleaning apparatus 22 while inserted so as to clean the interior of each machined hole 18 in sequence.

Robotic arm assembly 106 may, in turn, be coupled to, and operated by, a control system, such as computer 112, including one or more processors 114. Processor 114 may include software corresponding to a user interface, where the user interface permits an operator to program hole-cleaning system 110 to execute the desired sequence of movements and operations required to designate a series of machined fastener holes, to move the hole-cleaning apparatus 22 from designated machined fastener hole to designated machined fastener hole, and to clean the interiors of each designated machined fastener hole as described in the present disclosure. The user interface may accept inputs such as, for example, the dimensions of the work piece, the location of each hole to be designated and cleaned, the diameter 19 and/or depth of each designated hole 18, the length and diameter of elongate probe 26, the tension required to draw cleaning material from spool 32 using take-up motor 52, the amount of cleaning material 34 present in spool 32, and the like. The user interface may be configured so that the parameters for the cleaning of machined fastener holes 18 is specified by the operator. Alternatively, the user interface may permit an operator to simply input a series of defining parameters, such as for example the dimensions of the workpiece, including the coordinates of each machined fastener hole to be cleaned, as inputs, and the user interface may then create an appropriate hole cleaning pattern to satisfactorily clean each designated machined hole of the work piece.

Various aspects of the user interface, as well as the operating software to control the robotic assembly, may be embodied as a computer method, computer system, or computer program product. Accordingly, aspects of the present disclosure may take the form of an entirely hardware embodiment, an entirely software embodiment (including firmware, resident software, micro-code, and the like), or an embodiment combining software and hardware aspects, all of which may generally be referred to herein as a "module," or "system." Furthermore, aspects of the present disclosure may take the form of a computer program product embodied in a computer-readable medium (or media) having computer readable program code/instructions embodied thereon.

Instructions for an operating system, applications, and/or programs may be located in one or more storage devices in communication with the one or more processor units through a communications framework. The instructions may be in a functional form on a persistent storage. These instructions may be loaded into a memory for execution by processor 114.

These instructions may be referred to as program instructions, program code, computer usable program code, or computer readable program code that may be read and executed by processor 114. The program code in the different embodiments may be embodied on different physical or computer-readable media.

Any combination of computer-readable media may be utilized. Computer-readable media can be a computer-readable signal medium and/or a computer-readable storage medium. A computer-readable storage medium may include an electronic, magnetic, optical, electromagnetic, infrared, and/or semiconductor system, apparatus, or device, or any suitable combination of these. More specific examples of a computer-readable storage medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, and/or any suitable combination of these and/or the like. In the context of this disclosure, a computer-readable storage medium may include any suitable tangible medium that can contain or store a program for use by or in connection with an instruction execution system, apparatus, or device.

A computer-readable signal medium may include a propagated data signal with computer-readable program code embodied therein, for example, in baseband or as part of a carrier wave. Such a propagated signal may take any of a variety of forms, including, but not limited to, electromagnetic, optical, and/or any suitable combination thereof. A computer-readable signal medium may include any computer-readable medium that is not a computer-readable storage medium and that is capable of communicating, propagating, or transporting a program for use by or in connection with an instruction execution system, apparatus, or device.

Program code embodied on a computer-readable medium may be transmitted using any appropriate medium, including but not limited to wireless, wireline, optical fiber cable, RF, and/or the like, and/or any suitable combination of these. Computer program code for carrying out operations for aspects of the present disclosure may be written in any appropriate programming language. The program code may be written in a programming language intended for the robotic system being controlled, such as for example the TPP and KAREL programming languages that are useful for FANUC robotic systems. Alternatively or in addition, the program code may include any of a variety of programming languages, including object-oriented programming languages (such as Java, Smalltalk, C++, and/or the like), or conventional procedural programming languages (such as the C programming language, among others). The program code may execute entirely on a user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), and/or the connection may be made to an external computer (for example, through the Internet using an Internet Service Provider).

The computer program code or instructions can also be loaded onto a computer, other programmable data processing apparatus, and/or other device to cause a series of operational steps to be performed on the device to produce a computer-implemented process such that the instructions which execute on the computer or other programmable apparatus provide processes for implementing the functions/acts described herein and/or specified in flowchart 90. Any description, flowchart, or drawing in the present disclosure is intended to illustrate the architecture, functionality, and/or operation of possible implementations of systems, methods, and computer program products according to aspects of the present disclosure.

Example 7

This section describes additional aspects and features of the disclosed hole-cleaning apparatus, systems, and methods, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A1. A hole-cleaning apparatus, comprising:

a frame;

an elongate probe coupled to and projecting downwardly from the frame, the probe defining an internal passage extending from a lower end of the probe to an upper end of the probe;

a spool support having an aperture, being attached to the frame and configured to support a spool of a cleaning material in such a way that the cleaning material can be dispensed from the spool through the aperture along an outer surface of the elongate probe, into the internal passage at the lower end of the elongate probe, and upwardly through the internal passage; and a powered take-up mechanism mounted to the frame and configured to apply tension to a portion of the cleaning material extending out of the internal passage, to cause the cleaning material to be dispensed from the spool and collect the cleaning material after it has passed upwardly through the internal passage.

A2. The hole-cleaning apparatus of paragraph A1, wherein the apparatus is configured so that the cleaning material is pulled from the spool downwardly along the outer surface of the elongate probe, into the internal passage, and upwardly through the internal passage by the tension applied by the powered take-up mechanism.

A3. The hole-cleaning apparatus of paragraph A1, wherein the elongate probe includes a cylindrical tube, the interior of the tube defining the internal passage.

A4. The hole-cleaning apparatus of paragraph A1, wherein the elongate probe is configured to have an adjustably increased diameter.

A5. The hole-cleaning apparatus of paragraph A1, wherein the cleaning material includes a fibrous material.

A6. The hole-cleaning apparatus of paragraph A1, wherein the spool of cleaning material includes a longitudinally-rolled sheath of cleaning material.

A7. The hole-cleaning apparatus of paragraph A6, wherein the powered take-up mechanism is configured so that dispensing the cleaning material from the spool includes drawing the sheath of the cleaning material downwardly along the outer surface of the elongate probe to the lower end of the elongate probe, into the internal passage at the lower tip of the elongate probe, and pulling the cleaning material upwardly through the internal passage for collecting the cleaning material upon a take-up reel.

A8. The hole-cleaning apparatus of paragraph A1, wherein the spool of cleaning material includes a coil of cleaning strand.

A9. The hole-cleaning apparatus of paragraph A8, configured so that dispensing the cleaning material from the spool includes drawing the cleaning strand circumferentially from the coil along the outer surface of the elongate probe and pulling the cleaning fiber into the internal passage at the lower end of the elongate probe, pulling the cleaning strand upwardly through the internal passage, and collecting the cleaning strand upon a take-up reel of the powered take-up mechanism.

A10. The hole-cleaning apparatus of paragraph A1, wherein the elongate probe comprises a plurality of sections with incrementally smaller outer diameters along its length, each diameter of which is sized to fit within a predetermined diameter hole.

A11. The hole-cleaning apparatus of paragraph A1, wherein the frame is configured to be coupled to an end-effector of an industrial robotic arm assembly.

A12. The hole-cleaning apparatus of paragraph A11, further comprising a control system configured to autonomously operate the industrial robotic arm assembly and to activate the powered take-up mechanism.

B1. A hole-cleaning apparatus, comprising:

a support plate having an aperture therein;

a cylindrical tube disposed within the aperture in the support plate;

a rolled-up cleaning material disposed on top of the support plate around said aperture, with a portion of the rolled-up cleaning material being unrolled and extending through the aperture along the outside of the cylindrical tube and into the inside of the cylindrical tube; and a motor-driven drum coupled to a portion of the cleaning material extending through the inside of the cylindrical tube, wherein when the cylindrical tube is received within a hole containing sealant, operation of the motor-driven drum pulls the cleaning material through the cylindrical tube to continually dispense cleaning material from the support plate along the outside of the cylindrical tube received within the hole, to thereby remove sealant from within the hole.

B2. The hole-cleaning apparatus of paragraph B1, wherein the support plate comprises a horizontally oriented support plate and the aperture comprises a thru-hole therein having a diameter that is greater than the diameter of the cylindrical tube but less than or equal to the inside diameter of the rolled-up cleaning material.

B3. The hole-cleaning apparatus of paragraph B1, wherein the rolled-up cleaning material comprises a fabric sheath that is coiled into a generally annular shape to form a rolled-up cleaning material that may be unrolled to dispense cleaning material along the outside of the cylindrical tube.

B4. The hole-cleaning apparatus of paragraph B1, wherein the rolled-up cleaning material comprises a spool of cleaning strand disposed on top of the support plate around said aperture, with a portion of the cleaning strand extending through the aperture along the outside of the cylindrical tube and into the inside of the cylindrical tube, and wherein when the cylindrical tube is received within a hole containing sealant, operation of the motor-driven drum pulls the portion of cleaning strand extending through the cylindrical tube to continually dispense cleaning material from the spool along the outside of the cylindrical tube received within the hole, to thereby remove sealant from within the hole.

C1. A method of cleaning a hole, comprising:

installing a spool of a cleaning material on a hole-cleaning apparatus, wherein the hole-cleaning apparatus comprises a frame;

an elongate probe coupled to and projecting downwardly from the frame, the probe defining an internal passage extending from a lower end of the probe to an upper end of the probe;

a spool support having an aperture, being attached to the frame and configured to support the installed spool of cleaning material in such a way that the cleaning material can be dispensed from the spool through the aperture along an outer surface of the elongate probe into the internal passage at the lower end of the elongate probe, and through the internal passage; and a powered take-up reel mounted to the frame and configured to apply tension to the cleaning material, receive the cleaning material, and collect the cleaning material on the reel after it has passed upwardly through the internal passage;

drawing the cleaning material along an outer surface of the elongate probe, through the internal passage, and attaching the cleaning material to the powered take-up reel;

inserting the elongate probe into a hole; and operating the powered take-up reel so that the cleaning material being dispensed from the spool contacts and cleans an interior surface of the hole.

C2. The method of paragraph C1, wherein activating the powered take-up reel only occurs while the elongate probe is inserted into the hole.

C3. The method of paragraph C1, wherein inserting the elongate probe into the hole includes inserting the elongate probe into a hole machined in a workpiece component that includes two or more laminae separated by a sealant layer.

C4. The method of paragraph C1, further comprising:

removing the elongate probe from the hole; and measuring a diameter of the hole.

C5. The method of paragraph C1, wherein the hole-cleaning apparatus is coupled to an end-effector of an industrial robotic arm assembly, and inserting the elongate probe into the hole and activating the powered take-up reel occur autonomously.

ADVANTAGES, FEATURES, BENEFITS

The different embodiments and examples of the hole-cleaning apparatus described herein provide several advantages over known solutions for making hole quality measurements in work pieces that incorporate fay sealant, particularly for automated systems.

Automated systems may permit one-up assembly methods, that is where fastener holes are drilled, and then fasteners are inserted without disassembly and cleaning of the component parts. Unfortunately, in applications requiring high precision, the fastener holes must be measured and confirmed to be within specifications before the fastener is inserted.

Unfortunately, the use of a high precision hole-measurement device in a fastener hole that contains traces of fay sealant may not only produce inaccurate measurements, but may damage or even destroy the measuring device itself.

Currently, in order to prevent such damage, the automated assembly process must be halted, the assembly equipment removed, and the holes manually cleaned before hole measurements can be performed, wasting significant time.

Illustrative embodiments and examples of the hole-cleaning apparatus described herein permit an automated hole-cleaning process. By incorporating automated hole-cleaning into the one-up assembly process, the resulting manufacturing process requires less time and the quality of the product improves.

Additionally, and among other benefits, illustrative embodiments and examples described herein can allow every hole machined during a process to be cleaned, thereby permitting every hole to be measured, rather than relying upon the measurement of a representative sample of holes only, which may permit poor quality holes to pass undetected. By measuring every hole, overall quality is improved.

Additionally, and among other benefits, illustrative embodiments and examples described herein permit a single tool, whether manually or automatically operated, to clean multiple holes before the cleaning material must be replaced. Current hole-cleaning methods require one-use materials such as swabs. By facilitating multiple uses without reloading the cleaning material, the present apparatus lends itself to automated systems that may create hundreds of holes in a single component assembly.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A hole-cleaning apparatus, comprising:

a frame;

an elongate probe coupled to and projecting downwardly from the frame, the probe defining an internal passage extending from a lower end of the elongate probe to an upper end of the probe;

a spool support having an aperture, being attached to the frame and configured to support a spool of a cleaning material in such a way that the cleaning material can be dispensed from the spool through the aperture along an outer surface of the elongate probe, into the internal passage at the lower end of the elongate probe, and upwardly through the internal passage; and a powered take-up mechanism mounted to the frame and configured to apply tension to a portion of the cleaning material extending out of the internal passage, to cause the cleaning material to be dispensed from the spool and collect the cleaning material after it has passed upwardly through the internal passage.

2. The hole-cleaning apparatus of claim 1, wherein the apparatus is configured so that the cleaning material is pulled from the spool downwardly along the outer surface of the elongate probe, into the internal passage, and upwardly through the internal passage by the tension applied by the powered take-up mechanism.

3. The hole-cleaning apparatus of claim 1, wherein the elongate probe includes a cylindrical tube, the interior of the tube defining the internal passage.

4. The hole-cleaning apparatus of claim 1, wherein the elongate probe is configured to have an adjustably increased diameter.

5. The hole-cleaning apparatus of claim 1, wherein the cleaning material includes a fibrous material.

6. The hole-cleaning apparatus of claim 1, wherein the spool of cleaning material includes a longitudinally-rolled sheath of cleaning material.

7. The hole-cleaning apparatus of claim 6, wherein the powered take-up mechanism is configured so that dispensing the cleaning material from the spool includes drawing the sheath of the cleaning material downwardly along the outer surface of the elongate probe to the lower end of the elongate probe, into the internal passage at the lower tip of the elongate probe, and pulling the cleaning material upwardly through the internal passage for collecting the cleaning material upon a take-up reel.

8. The hole-cleaning apparatus of claim 1, wherein the spool of cleaning material includes a coil of cleaning strand.

9. The hole-cleaning apparatus of claim 8, configured so that dispensing the cleaning material from the spool includes drawing the cleaning strand circumferentially from the coil along the outer surface of the elongate probe and pulling the cleaning strand into the internal passage at the lower end of the elongate probe, pulling the cleaning strand upwardly through the internal passage, and collecting the cleaning strand upon a take-up reel of the powered take-up mechanism.

10. The hole-cleaning apparatus of claim 1, wherein the elongate probe comprises a plurality of sections with incrementally smaller outer diameters along its length, each diameter of which is sized to fit within a predetermined diameter hole.

11. The hole-cleaning apparatus of claim 1, wherein the frame is configured to be coupled to an end-effector of an industrial robotic arm assembly.

12. The hole-cleaning apparatus of claim 11, further comprising a control system configured to autonomously operate the industrial robotic arm assembly and to activate the powered take-up mechanism.

13. A hole-cleaning apparatus, comprising:

a support plate having an aperture therein;

a cylindrical tube disposed within the aperture in the support plate;

a rolled-up cleaning material disposed on top of the support plate around said aperture, with a portion of the rolled-up cleaning material being unrolled and extending through the aperture along the outside of the cylindrical tube and into the inside of the cylindrical tube; and a motor-driven drum coupled to a portion of the cleaning material extending through the inside of the cylindrical tube, wherein when the cylindrical tube is received within a hole containing sealant, operation of the motor-driven drum pulls the cleaning material through the cylindrical tube to continually dispense cleaning material from the support plate along the outside of the cylindrical tube received within the hole, to thereby remove sealant from within the hole.

14. The hole-cleaning apparatus of claim 13, wherein the support plate comprises a horizontally oriented support plate and the aperture comprises a thru-hole therein having a diameter that is greater than the diameter of the cylindrical tube but less than or equal to the inside diameter of the rolled-up cleaning material.

15. The hole-cleaning apparatus of claim 13, wherein the rolled-up cleaning material comprises a fabric sheath that is coiled into a generally annular shape to form a rolled-up cleaning material that may be unrolled to dispense cleaning material along the outside of the cylindrical tube.

16. The hole-cleaning apparatus of claim 13, wherein the rolled-up cleaning material comprises a spool of cleaning strand disposed on top of the support plate around said aperture, with a portion of the cleaning strand extending through the aperture along the outside of the cylindrical tube and into the inside of the cylindrical tube, and wherein when the cylindrical tube is received within a hole containing sealant, operation of the motor-driven drum pulls the portion of cleaning strand extending through the cylindrical tube to continually dispense cleaning material from the spool along the outside of the cylindrical tube received within the hole, to thereby remove sealant from within the hole.

17. A method of cleaning a hole, comprising:

installing a spool of a cleaning material on a hole-cleaning apparatus, wherein the hole-cleaning apparatus comprises a frame;

an elongate probe coupled to and projecting downwardly from the frame, the probe defining an internal passage extending from a lower end of the probe to an upper end of the probe;

a spool support having an aperture, being attached to the frame and configured to support the installed spool of cleaning material in such a way that the cleaning material can be dispensed from the spool through the aperture along an outer surface of the elongate probe into the internal passage at the lower end of the elongate probe, and through the internal passage; and a powered take-up reel mounted to the frame and configured to apply tension to the cleaning material, receive the cleaning material, and collect the cleaning material on the reel after it has passed upwardly through the internal passage;

drawing the cleaning material along an outer surface of the elongate probe, through the internal passage, and attaching the cleaning material to the powered take-up reel;

inserting the elongate probe into a hole; and operating the powered take-up reel so that the cleaning material being dispensed from the spool contacts and cleans an interior surface of the hole.

18. The method of claim 17, wherein activating the powered take-up reel only occurs while the elongate probe is inserted into the hole.

19. The method of claim 17, wherein inserting the elongate probe into the hole includes inserting the elongate probe into a hole machined in a workpiece component that includes two or more laminae separated by a sealant layer.

20. The method of claim 17, further comprising:

removing the elongate probe from the hole; and measuring a diameter of the hole.

21. The method of claim 17, wherein the hole-cleaning apparatus is coupled to an end-effector of an industrial robotic arm assembly, and inserting the elongate probe into the hole and activating the powered take-up reel occur autonomously.

* * * * *